US005752136A

United States Patent [19]

Sanchez et al.

[11] Patent Number: 5,752,136

[45] Date of Patent: May 12, 1998

[54] IMAGING MEMBER END FLANGE AND END FLANGE ASSEMBLY

[75] Inventors: Ismael R. Sanchez; Robert S. Foltz, both of Rochester; Warren F. Brydges, Macedon; William A. Hammond, Rochester; Eugene A. Swain, Webster; John K. Williams, Monroe Fairport; Richard C Petralia, Rochester; Thong H. Vo, Webster, all of N.Y.

[73] Assignee: Xerox Corporation, Stamford, Conn.

[21] Appl. No.: 536,033

[22] Filed: Sep. 29, 1995

[51] Int. Cl.[6] ..... G03G 21/00

[52] U.S. Cl. ..... 399/117; 399/167; 492/47

[58] Field of Search ..... 355/211, 200, 355/210; 492/21, 45, 47; 403/26, 88, 83; 399/116, 117, 167

[56] References Cited

U.S. PATENT DOCUMENTS

| | | | |
|---|---|---|---|
| 2,044,640 | 6/1936 | Schuster | 492/21 |
| 2,558,689 | 6/1951 | Miller | 492/21 X |
| 2,964,834 | 12/1960 | Edwards | 492/21 |
| 4,040,157 | 8/1977 | Shanly | 492/47 X |
| 4,105,345 | 8/1978 | Wagner | 355/211 X |
| 4,386,839 | 6/1983 | Kumagai et al. | 355/200 |
| 4,400,077 | 8/1983 | Kozuka et al. | 355/211 |
| 4,561,763 | 12/1985 | Basch | 355/200 |
| 4,839,690 | 6/1989 | Onoda et al. | 355/211 |
| 4,975,744 | 12/1990 | Ebata et al. | 355/211 |
| 5,052,090 | 10/1991 | Kitaura et al. | 492/45 X |
| 5,210,574 | 5/1993 | Kita | 355/211 |
| 5,357,321 | 10/1994 | Stenzel et al. | 333/211 |
| 5,402,207 | 3/1995 | Michlin | 355/200 |
| 5,599,265 | 2/1997 | Foltz | 492/47 |
| 5,655,182 | 8/1997 | Sanchez et al. | 399/117 |

FOREIGN PATENT DOCUMENTS

| | | |
|---|---|---|
| 4-128849 | 4/1992 | Japan . |
| 4-356090 | 9/1992 | Japan . |
| 4-358192 | 11/1992 | Japan . |
| 6-110361 | 4/1994 | Japan . |

*Primary Examiner*—Nestor R. Ramirez

[57] ABSTRACT

A hollow cylindrical electrostatographic imaging member supporting end flange including a disk shaped member, a supporting hub extending axially from the disk shaped member and a metal disk coaxially secured to the hub, the disk comprising a plurality of rectangular tabs extending radially from the disk in a direction away from an imaginary axis of the hub for engagement with the hollow cylindrical electrostatographic imaging member upon insertion of the hub and disk shaped member into one end of the hollow cylindrical electrostatographic imaging member. When this end flange is inserted into one end of the hollow cylindrical electrostatographic imaging member, the plurality of rectangular tabs extending radially from the disk engage the inner surface of the hollow cylindrical electrostatographic imaging member.

18 Claims, 2 Drawing Sheets

IMAGING MEMBER END FLANGE AND END FLANGE ASSEMBLY

CROSS REFERENCE TO RELATED APPLICATION

This application is related to U.S. patent application Ser. No. 08/359,253, filed Dec. 19, 1994 and entitled "Barbed Ring Flange Assembly" by Robert S. Foley; to U.S. patent application Ser. No. 08/485,080, filed Jun. 7, 1995, and entitled "Method and Apparatus For Reusing A Photoreceptor and Gear Assembly" by Ismael R. Sanchez et al.; and to U.S. patent application Ser. No. 08/483,000, filed Jun. 7, 1995 and entitled "Resiliently Biased End Caps for Photoconductive Drums" by Moritz P. Wagner et al.

BACKGROUND OF THE INVENTION

The present invention relates to a method and apparatus for reusing photoreceptor and end flange assemblies used, for example, in electrostatographic imaging machines.

The recovery and reuse of machine components is commonplace among manufacturers of sophisticated electronic equipment, such as electrostatographic imaging machines. The impetus for the recovery and reuse of these components is both environmental and economic. At the heart of any electrostatographic imaging machine such as copiers, duplicators and printers is an electrostatographic imaging member assembly. One part of the assembly is a cylindrical electrostatographic imaging member, such as an electrophotographic imaging member (i.e. photoreceptor) or electrographic imaging member, which is rotated to reproduce images. For the sake of convenience, the expression "photoreceptor" will be used in following discussion. However, an electrographic imaging member may, in many situations, be substituted for the photoreceptor. Typically, the photoreceptor is supported by end flanges at each end, the combination comprising an electrostatographic imaging member assembly. One of the end flanges may carry a gear to facilitate rotation of the cylindrical photoreceptor. The gear may be an integral part of the end flange or a component that is attached to the end flange. Conventionally, a portion of the end flange is glued to the inside surface of a hollow, cylindrical photoreceptor. When such a photoreceptor is no longer functional, the end flange assembly must be separated from the photoreceptor for recycling of the end flange and refurbishing or scrapping of the photoreceptor. In practice, efforts to separate the end flange and photoreceptor have proven unsatisfactory since this requires a great deal of time and care to assure that the photoreceptor and end flange are not damaged upon breaking the glued seal with the photoreceptor. Many times the end flange is cracked or broken with parts of the flange remaining glued to the inside of the photoreceptor. Further, the photoreceptor surface is damaged due to the force required to break the glued seal. The presence of residual glue on either the end flange or photoreceptor can also hinder reuse. Employment of solvents to soften solvent soluble glues to facilitate removal of residual glue can present solvent containment and disposal problems. There is, therefore, a need for a glueless method of securing and subsequently removing end flanges from the inside surface of photoreceptors which allows the end flanges and photoreceptors to be reused.

Further, when end flanges are glued to a photoreceptor, electrical grounding of the conductive substrate component of the photoreceptor requires supplemental devices such as metal leaf springs connecting the conductive substrate to a metal shaft which supports the photoreceptor.

INFORMATION DISCLOSURE STATEMENT

U.S. Pat. No. 4,839,690 to Onoda et al., issued Jun. 13, 1989—An image bearing member is disclosed comprising which is detachably mounted into a main assembly, and which is to be electrically connected with the main assembly. The image bearing member has a conductive drum member having an insulating flange. Adjacent an inside end of the insulating flange, a conductive member is provided in the manner it is electrically connected to an inner surface of the conductive drum member. The conductive member is electrically connected with a conductive member of a main assembly when the image bearing member is mounted in the main assembly.

U.S. Pat. No. 4,975,744 to Ebata et al., issued Dec. 4, 1990—The improvement in the driving mechanism and positioning mechanism between an image bearing member and a main assembly of an image forming apparatus using the image bearing member is disclosed. The image bearing member has a shaft receiving portion adjacent the center thereof to receive a positioning shaft of the main assembly when the image bearing member is mounted in said main assembly. By the receiving engagement, the image bearing member is correctly positioned with respect to the main assembly. The image bearing member is also provided with a driving force receiving portion where the image bearing member is engaged with a driving member of the main assembly so that the image bearing member can be driven from the main assembly. In such an arrangement, the shaft receiving portion and the driving force receiving portion are radially overlapped, at least in part, with each other as seen from a rotational axis of the image bearing member.

U.S. Pat. No. 5,210,574 to Kita, issued May 11, 1993—An image-forming machine is disclosed comprising a photosensitive drum on which a toner image is to be formed on the peripheral surface thereof, a transfer drum onto which is removably fitted an image-forming sheet member onto which said toner image will be transferred, and a cleaning device that removes the toner remaining on the peripheral surface of the photosensitive drum after the transfer of image has been finished. The image-forming area on the peripheral surface of the photosensitive drum is defined inside the portions that correspond to both side edges of the transfer sheet member of the transfer drum. A cleaning blade in the cleaning device is present continuously over the image-forming area but does not extend up to portions that correspond to both side edges of the transfer sheet. The photosensitive drum includes a pair of flange members and a photosensitive drum body mounted to the flange member. A drive coupling member made of a resilient metal is secured to one of the flange members, and has a coupling protrusion that bites into the inner surface of the photosensitive drum body.

U.S. Pat. No. 5,357,321 to Stenzel et al., issued Oct. 18, 1994—A drum supporting hub is disclosed comprising a disk shaped member having a circular periphery, a hole extending axially through the center of the disk shaped member, and at least one long thin electrically conductive resilient member secured to the disk shaped member, the resilient member having a central section adjacent the hole and having opposite ends, each of the ends terminating into at least one pointed tip adjacent the circular periphery of the disk shaped member, and the resilient member having a major plane substantially parallel to the axis of the disk shaped member. This hub may be inserted in at least one end of a cylindrical electrostatographic imaging member to produce an imaging member assembly.

U.S. Pat. No. 4,561,763 to Basch, issued Dec. 31, 1985—A drum supporting hub having a tapered pot-like hub configuration is disclosed comprising a bottom section and a rim, the rim comprising a plurality of circumferentially spaced resilient fingers extending at a slight incline outwardly from the axis of the pot-like hub away from the bottom section, at least three of the fingers having lips at the ends of the fingers, the lips projecting away from the axis for engagement with an end of a cylindrical drum upon insertion of the pot-like hub into the drum, the rim other than the lips having an outside diameter slightly larger than the outside diameter of the bottom. The drum supporting hub is employed in a drum assembly comprising the hub, a cylindrical drum having a circular cross-section and a shaft positioned along the axis of the drum.

U.S. Pat. No. 4,386,839 to Kumagai et al., issued Jun. 7, 1983—A photosensitive drum in an electrostatic copying apparatus is disclosed comprising a drum body and a photosensitive layer provided around the outer peripheral surface of the drum body, a supporting mechanism for rotatably and detachably supporting the photosensitive drum, and peripheral devices which are in contact with the outer peripheral surface of the photosensitive drum at a contact force of 50 g. The drum body is formed of a thin metal tubular body of which the strength per unit length is 2.4 Kg/mm or less, whereby the drum body when it has been removed from the supporting mechanism may be crushed by foot.

U.S. Pat. No. 4,400,077 to Kozuka et al., issued Aug. 23, 1983—A photosensitive drum assembly for an electrostatic copying apparatus is disclosed comprising a cylindrical drum having a photosensitive layer provided around its outer periphery. The drum is held between a pair of flanges at opposite axial ends of the drum. Each of the flanges is formed having a diameter larger than the external diameter of the drum. At the edge of each flange, is a cylindrical portion extending along the axis of the drum to face toward the opposite flange. The end edges of the drum closely fit into the cylindrical portions. According to the present invention, since the edges of the drum closely fit into the cylindrical portions of the flanges, it is not necessary to improve the dimensional accuracy of the inside periphery of the opposite ends of the drum, while it is essential to improve the dimensional accuracy in a conventional manner.

U.S. Pat. No. 5,052,090 to Kitaura et al, issued Oct. 1, 1991—A flange for a drum is disclosed. The flange is mounted on one end of the drum to rotate together wit it, and comprises a hole passing therethrough along the axis of rotation to receive a rotation shaft therethrough, so that the flange can rotate together with the rotation shaft. The hole comprises an inside portion having an oblong cross section and an outside portion having a perfectly circular cross section, the inside portion being located toward the drum, and the outside portion being open toward the outside. One end portion of the rotation shaft has an oblong cross section and is securely fitted in the oblong portion of the hole. When the drum is to be tested for concentricity with the rotation shaft, a conical rotation pin is inserted into the circular portion of the hole so that the flange can be rotated concentrically with, and together with the conical rotation pin.

SUMMARY OF THE INVENTION

It is, therefore, an object of the present invention to provide an improved photoreceptor assembly which overcomes the above-noted deficiencies.

It is yet another object of the present invention to provide an improved photoreceptor assembly comprising a reusable gear assembly which is removably secured to a photoreceptor after inserting the gear assembly into an open end of the photoreceptor.

It is still another object of the present invention to provide an improved photoreceptor assembly free of adhesive material between an end flange and the adjacent surface of a cylindrical photoreceptor.

The foregoing objects and others are accomplished in accordance with this invention by providing a hollow cylindrical electrostatographic imaging member supporting end flange comprising a disk shaped member, a supporting hub extending axially from the disk shaped member and a metal disk coaxially secured to the hub, the disk comprising a plurality of rectangular tabs extending radially from the disk in a direction away from an imaginary axis of the hub for engagement with the hollow cylindrical electrostatographic imaging member upon insertion of the hub and disk shaped member into one end of the hollow cylindrical electrostatographic imaging member. When this end flange is inserted into one end of the hollow cylindrical electrostatographic imaging member, the plurality of rectangular tabs extending radially from the disk engage the inner surface of the hollow cylindrical electrostatographic imaging member. The combination of an end flange and electrostatographic imaging member is referred to as a electrostatographic imaging member assembly.

BRIEF DESCRIPTION OF THE DRAWINGS

A more complete understanding of the process of the present invention can be obtained by reference to the accompanying drawings wherein.

The figures are merely schematic illustrations of the prior art and the present invention. They are not intended to indicate the relative size and dimensions of electrostatographic imaging member assemblies or components thereof.

DETAILED DESCRIPTION OF PREFERRED EMBODIMENTS

Figure 1:
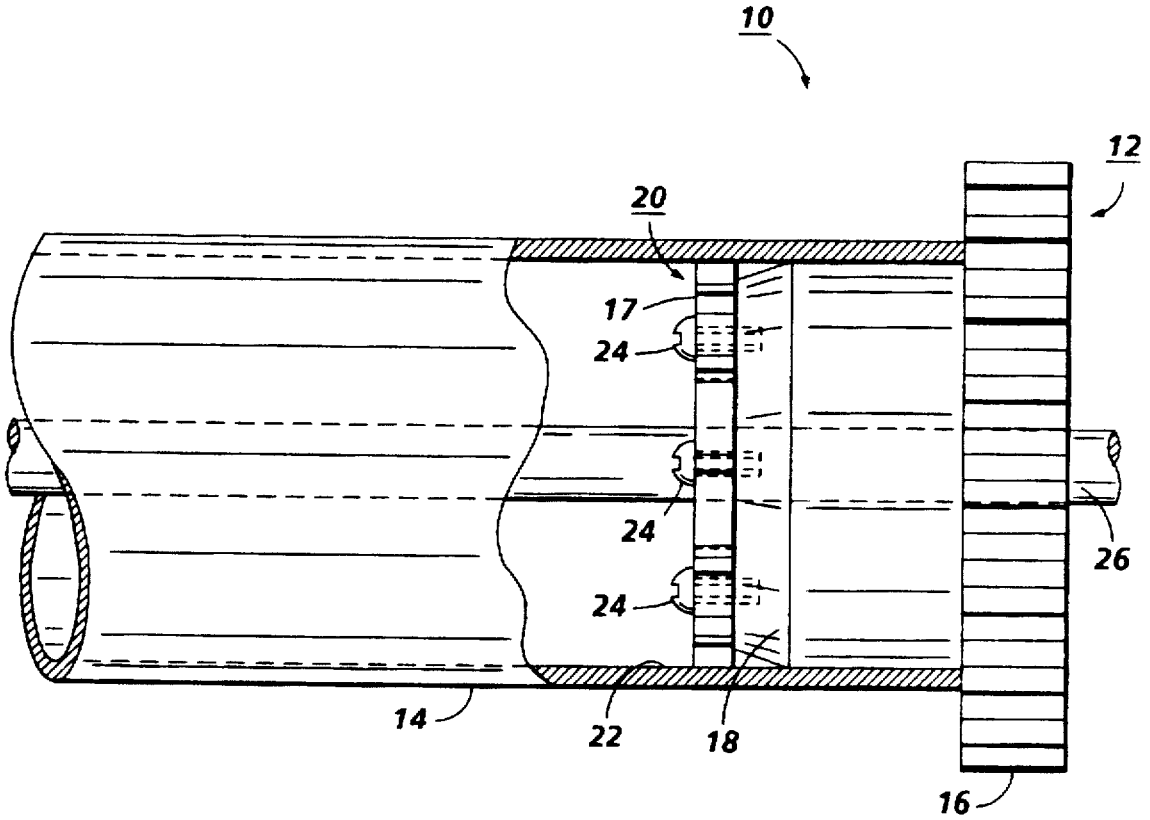
FIG. 1 is a schematic side view depicting a partial view of an electrostatographic imaging member assembly comprising an end flange within one end of a hollow cylindrical electrostatographic imaging member according to one embodiment of the present invention.

FIG. 1 is a side view depicting a photoreceptor assembly 10 comprising an end flange 12 partially extending into the interior of a hollow cylindrical photoreceptor 14. End flange 12 comprises a disk shaped member 16, a supporting hub 18 extending axially from the disk shaped member 16 into one end of the hollow cylindrical photoreceptor 14, and a flat metal disk shaped member 17 coaxially secured to hub 18. Metal disk shaped member 17 has a substantially circular shape and comprises a plurality of rectangular tabs 20 extending radially in a direction away from and perpendicular to an imaginary axis of hub 18 into engagement with the inner surface 22 of the hollow cylindrical electrostatographic imaging member 14. Metal disk shaped member 17 may be secured to hub 18 by any suitable means such as self tapping screws 24, threaded stud and nut combinations (not shown), ultrasonic staking, and the like. In FIG. 1, disk shaped member 16 is illustrated as a gear. However, a gear may be omitted and disk shaped member 16 may have a smooth outer surface (not shown) instead carrying gear teeth. Gears may optionally be made a part of or attached to disk shaped member 16 to facilitate rotation of photoreceptor assembly 10 around shaft 26 during an electrostatographic imaging process as is will known in the art. Generally, a gear is employed at only one end of a hollow cylindrical photoreceptor because the end flange at the other end of the photoreceptor is normally not driven. If desired, the combination of disk shaped member 16 and supporting hub 18 may be of a unibody plastic design, fabricated, for example, by molding.

Figure 2:
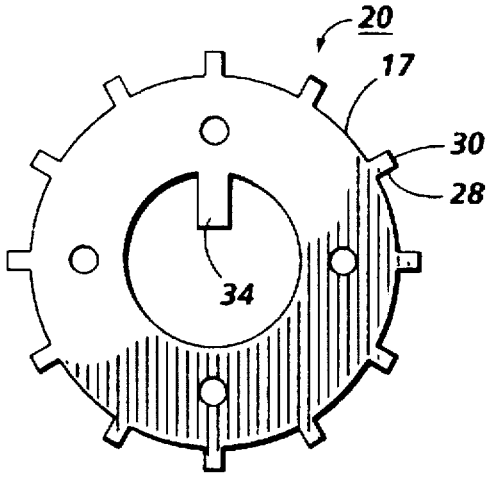
FIG. 2 is a schematic front view of a disk shaped member component of an end flange according to one embodiment of the present invention.
Figure 3:
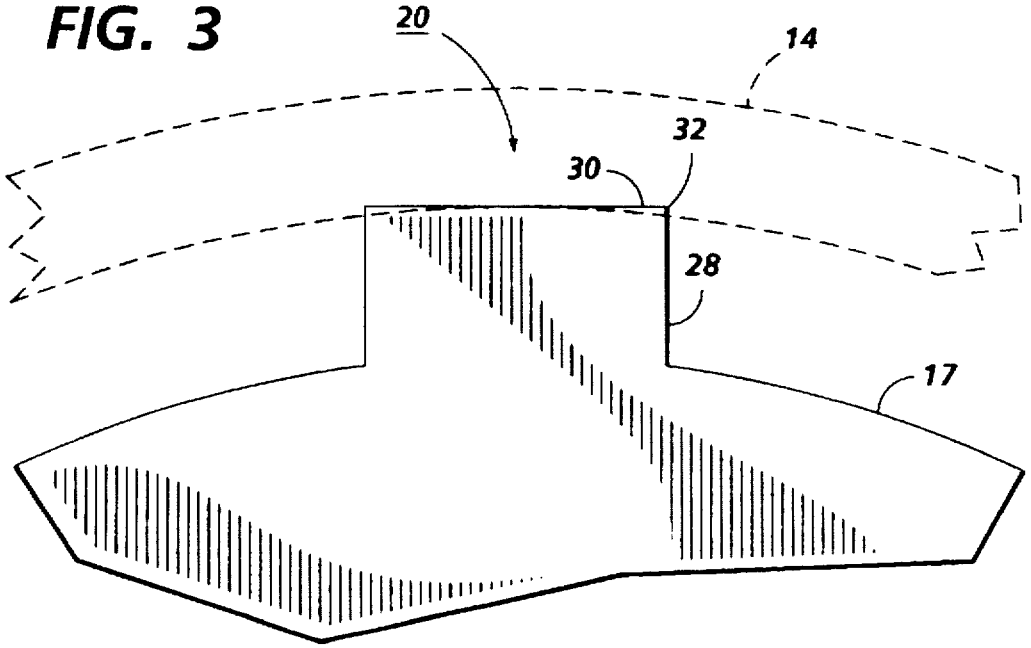
FIG. 3 is an expanded schematic view of the disk shaped member component of the end flange illustrated in FIG. 2.

FIG. 2 is a front view of the metal disk shaped member 17. As described above, metal disk shaped member 17 has a substantially circular shape and comprises a plurality of rectangular tabs 20 extending radially in a direction away from an imaginary axis of hub 18 into engagement with the inner surface 22 of the hollow cylindrical electrostatographic imaging member 14. Rectangular tabs 20 protrude radially in a direction away from the center of disk shaped member 16 in the form of gear-like rectangular teeth. The expression rectangular as employed herein is defined as having a shape similar to a square wave in which the length of each side of a wave is greater than, equal to or less than the length of the top of each wave. Each side 28 of rectangular tabs 20 forms with the top 30 of rectangular tabs 20 a substantially right angle junction 32 (i.e. a corner). Typically, brass disk shaped member 17 having a thickness of about 0.457 mm carries about 12 rectangular tabs 20 substantially uniformly distributed around the outer periphery of disk shaped member 16. Thus, rectangular tabs 20 are substantially evenly spaced around the circumference of disk shaped member 16. Each tab 20 preferably has the same dimensions. Preferably, the overall diameter of the metal disk shaped member 17, as measured by an imaginary circle joining the center point 34 of the tops of tabs 20 should be substantially equal to the inside diameter of the inner surface 22 of the hollow cylindrical electrostatographic imaging member 14. Thus, for example, if the inside diameter of the inner surface 22 of a typical hollow cylindrical electrostatographic imaging member 14 is about 28.5 mm, the diameter of the an imaginary circle joining the center point of the tops of tabs 20 should also be about 28.5 mm. This ensures that the junctions 32 of rectangular tabs 20 embed themselves into the inner surface 22 of the hollow cylindrical electrostatographic imaging member 14 to achieve an interference fit which, in turn, allows driving of end flange 12 without slippage between end flange 12 and the inner surface 22 of hollow cylindrical photoreceptor 14. The overall diameter of the metal disk shaped member 17, as measured by an imaginary circle joining the center point of the tops of tabs 20 should not be greater than the inside diameter of the Inner surface 22 of the hollow cylindrical electrostatographic imaging member 14, because this would prevent insertion of disk shaped member 16 and supporting hub 18 into the interior of hollow cylindrical photoreceptor 14. The center of metal disk shaped member 17 may also contain key tab 34 for shaft 26. A typical ground means is also illustrated in FIG. 2 where a clip 34 extends from the metal disk shaped member 17 into contact with the shaft 26 (see FIG. 1).

The metal disk shaped member may comprise any suitable electrically conductive material. Typical metals materials include, for example, brass, steel, stainless steel, bronze, metallic fiber reinforced composites, and the like. Thus, the expression "metal disk" as employed herein includes disks that are totally constructive of metal and disks that contain metal such as metal fibers.

Preferably, the thickness of the rectangular tabs should be the same as the thickness of the rest of the metal disk shaped member to minimize stress on the tabs. The metal disk shaped member should have sufficient thickness and rigidity to allow pushing of the end flange into the interior of the cylindrical photoreceptor without plastic bending or yielding of the rectangular tabs. Thus, the minimum thickness of the metal disk shaped member will depend on factors such as the specific metal used for the tabs and the length of the sides and tops of the tabs. However, the materials and dimensions selected should be sufficient to prevent bending beyond their yielding stress and plastic deformation. By avoiding permanent deformation, the end flanges remain reusable and prevent any relative movement between the end flange and the inner surface of the photoreceptor when a rotational force is applied to the end flange. Typical thicknesses for the metal disk shaped member are between about 0.3 millimeter and about 1 millimeter.

The yield strength of the material employed in the metal disk shaped member should be greater than that of the material used for the inner surface of the hollow photoreceptor. Thus, to ensure ploughing by the corners of the rectangular tabs into the inner surface of the hollow photoreceptor and to avoid permanent deformation of the tabs, the tensile yield stress point of the tabs should be at least about 10 percent greater than the tensile yield stress point of the inner surface material of the cylindrical photoreceptor.

The dimensions of the length of the sides and tops of the rectangular tabs also depend upon numerous factors such as the total number of tabs employed, the size of the inner circumference of the hollow photoreceptor, the hardness of the material employed in the inner circumference of the hollow photoreceptor, the amount of torque needed to rotate the end flange, and the like. The length of the sides and tops of the rectangular tabs should be sufficient to achieve embedding of the corners of the tabs into the inner surface of the hollow photoreceptor to a depth of at least about 10 micrometers. However, the optimum depth of penetration will vary depending upon materials and size variables such as those described above. Preferably, the length of the sides of a rectangular tab is at least about 0.25 millimeter and typically up to about 1 millimeter. The length of the top of a rectangular tab is preferably at least about 2 millimeters. The length of the top of a rectangular tab should be sufficient to achieve embedding of the corners of the tabs into the inner surface of the hollow photoreceptor to a depth of at least about 10 micrometers. A tab that is too long or too narrow will tend to bend and permanently deform when inserted into an end of a photoreceptor. A tab that has sides or top that are are too long will tend to cause undesirable deformation of the outer imaging surface of the photoreceptor during and after installation in a photoreceptor. The shape of the tabs after installation into one end of the photoreceptor should be substantially the same shape as the shape immediately prior to installation. The specific tab dimensions to prevent plastic deformation and to achieve sufficient tab rigidity will vary depending upon the materials employed and the other factors described above. The number of tabs positioned around the periphery of the metal disk shaped member is preferably at least 3 to ensure symmetry and centering relative to the photoreceptor after insertion. The insertion force required to insert the metal disk into the hollow interior of the photoreceptor will affect the number of tabs employed. The tab material yield strength should resist the bending moment induced by the insertion force. The maximum number of tabs will also be dependent on the material strength of the metal disk. Typically, between 3 and about 24 tabs are satisfactory. To ensure symmetry of insertion and symmetry of radial deformation of the photoreceptor diameter the tab locations should be identical based on a mirror plane across the diameter of the disk. Typical thicknesses for the metal disk shaped member ranges from between about 0.3 millimeter and about 1 millimeter and more preferably from between about 0.45 millimeter and about 0.5 millimeter. However, thicknesses outside this range may be employed provided that permanent deformation of the metal disk shaped member, including the tabs, is avoided. Preferably, the size and number of tabs should provide a torque resistance of at least about 0.5 Newton-meter without slippage between the end flange and the hollow photoreceptor.

The center of the top of a tab of should be immediately adjacent to the inner surface of the photoreceptor. The center of the top of the tab may lightly contact the inner surface of the photoreceptor but should not block insertion of the metal disk into the interior of the hollow photoreceptor. This ensures precise centering of the end flange relative to the photoreceptor and sufficient ploughing of all the corners of all the tabs into the inner surface of the photoreceptor. The expression "center point" as employed herein is defined as the center of a straight line connecting the two outermost corners of a tab. The outermost corners are the junctions between a tab side and a tab top. Thus, if an imaginary circle (representing the inner surface of the photoreceptor) is drawn joining the center point of the tops of tabs 20, a straight line drawn along the flat top of each tab will be tangent to the imaginary circle at the center point of the top of each tab 20 and the two corners of each tab will extend past the imaginary circle, i.e. will penetrate and embed into the inner surface of the photoreceptor. These embedded corners are the primary contact points with the inner surface of the photoreceptor. As described above, the size and number of tabs should provide a torque resistance of at least about 26 inch pounds without slippage between the end flange and the hollow photoreceptor. When and end flange of this invention is pressed into one end of a hollow photoreceptor, the tabs actually dig into the inner surface of the photoreceptor and shave a "V" shaped strip of material from the inner surface of the photoreceptor. This shaped strip remains attached to the inner surface of the photoreceptor. Since the metal disk is in contact with the inner surface of the photoreceptor, it can serve as a grounding strip, the supporting which extends lengthwise through the cylindrical photoreceptor and passes through the end flange, including the metal disk, may provide grounding for the photoreceptor assembly. A typical ground means is illustrated in FIG. 2 where a clip 34 extends from the metal disk shaped member 17 into contact with the shaft 26 (see FIG. 1).

Generally, little or no clearance is preferred between the inner surface of the photoreceptor and the maximum diameter portions of the end flange hub. This prevents any play of the end flange after installation into one end of the hollow photoreceptor. Generally, any clearance should be so narrow that the distance separating the hub and inner surface is indiscernible. Thus, when the end flange is installed, friction is created between the hub surface and the inner surface of the photoreceptor.

Any suitable hollow cylindrical electrostatographic imaging member may be utilized with the end flange of this invention. Generally, hollow cylindrical electrophotographic imaging members comprise a photoconductive layer comprising a single layer or composite layers on a supporting cylindrical substrate. One type of composite photoconductive layer used in xerography is illustrated, for example, in U.S. Pat. No. 4,265,990 which describes a photosensitive member having at least two electrically operative layers. The disclosure of this patent is incorporated herein in its entirety. One layer comprises a photoconductive layer which is capable of photogenerating holes and injecting the photogenerated holes into a contiguous charge transport layer. The supporting cylindrical substrate may comprise any suitable metallic, organic, or composite material. Typical metallic materials include, for example, aluminum, nickel, and the like. Typical organic or composite materials include, for example, filled or unfilled polycarbonate, acrylonitrile butadiene styrene copolymer (ABS), and the like. Generally, the supporting cylindrical substrate should be sufficiently thick to support the overlying photoconductive materials without adverse distortion during imaging. The thickness of the substrate varies with the strength of the specific materials selected for the substrate. Typically, a typical aluminum metal substrate preferably has a thickness of at least about 0.75 millimeters. Metal substrates are preferred because they are electrically conductive, and can grip the corners of the embedded rectangular tabs with greater strength to resist slippage due to applied torque.

In a typical example, a number of hollow aluminum cylindrical photoreceptor substrates (i.e. aluminum drums) were provided. Each drum had a thickness of about 0.75 millimeter and had an inside diameter of about 28.5 millimeters. An end flange similar in shape to that illustrated in FIG. 1 was inserted into one end of the hollow cylindrical photoreceptor. The end flange comprised a molded plastic disk shaped gear at one end, a supporting hub extending axially from the disk shaped gear and a brass disk coaxially secured to the hub by two protruding shafts and "c" clips. The supporting hub had a length of about 10.0 millimeters and a diameter of about 28.25 millimeters. A brass disk was provided having a generally circular shape similar to that illustrated in FIGS. 1 and 2 with 12 rectangular tabs. The thickness of the tabs as well as the rest of the brass disk was about 0.486 millimeter. The dimensions of each rectangular brass tab was about 0.5 millimeter for the length of each tab side and about 2 millimeters for the length of each tab top measured in a direction parallel to the plane of the two major surfaces of the brass disk. An imaginary circle drawn through the center points of the tab tops had a diameter of about 28.5 millimeters. When the brass disk and supporting hub of the end flange was pushed into one end of the hollow drum, the 24 corners of the 12 tabs shaved "V" shaped strips of aluminum from the inner surface of the photoreceptor and the corners of the tabs became embedded into the inner surface of the hollow drum upon completion of installation of the end flange. Each photoreceptor drum assembly was tested for torque resistance and was found to resist an applied torque greater than 3.0 Newton-meters without slippage between the end flange and the hollow photoreceptor. Reusability of the photoreceptor drum assembly components was tested by inserting and removing the end flange three different times, twice into the same side of the photoreceptor. It was found that after each reinstallation the resulting photoreceptor assembly resisted an applied torque greater than 3.0 Newton-meters without slippage between the end flange and the hollow photoreceptor drum. The assembly was exposed to high temperature (60 degrees C.) and low temperatures (−20 degrees C.) and retested for torque resistance. On both instances the assembly did not fail under an applied torque of 3.0 Newtonmeters. All of these photoreceptor assemblies provided excellent torque transfer, continuity, and dimensional functionality.

Although the invention has been described with reference to specific preferred embodiments, it is not intended to be limited thereto, rather those skilled in the art will recognize that variations and modifications may be made therein which are within the spirit of the invention. It is intended that all such variations and modifications are included insofar as they come within the scope of the claims or equivalents thereof.

What is claimed is:

1. A hollow cylindrical electrostatographic imaging member supporting end flange comprising a disk shaped member, a supporting hub extending axially from said disk shaped member and a flat rigid metal disk coaxially secured to said hub, said metal disk comprising a plurality of rectangular tabs extending radially from said metal disk in a direction away from and perpendicular to an imaginary axis of said hub for engagement with said hollow cylindrical electrostatographic imaging member upon insertion of said hub and disk shaped member into one end of said hollow cylindrical electrostatographic imaging member.

2. An imaging member according to claim 1 wherein said metal disk has a thickness between about 0.3 millimeter and about 1 millimeter.

3. An imaging member according to claim 1 wherein said rectangular tabs have a pair of parallel sides and a top that is perpendicular to said sides, said sides having a length between about 0.25 millimeter and about 1 millimeter.

4. An imaging member according to claim 1 wherein said metal disk has between 3 and about 24 of said tabs.

5. An imaging member according to claim 4 wherein said tabs are substantially uniformly spaced around the outer periphery of said metal disk.

6. An electrostatographic imaging member assembly comprising a hollow cylindrical electrostatographic imaging member having a circular cross section and an inner surface and at least one end flange, said end flange comprising a disk shaped member, a supporting hub extending axially from said metal disk shaped member into one end of said hollow cylinder and a flat rigid metal disk coaxially secured to said hub, said metal disk comprising a plurality of rectangular tabs extending radially from said disk in a direction away from and perpendicular to an imaginary axis of said hub into engagement with said inner surface of said hollow cylindrical electrostatographic imaging member.

7. An imaging member assembly according to claim 6 wherein said metal disk has a tensile yield stress point that is about 10 percent greater than the tensile yield stress point of said inner surface of said hollow cylindrical electrostatographic imaging member.

8. An imaging member assembly according to claim 6 wherein each of said rectangular tabs have a pair of parallel sides and a top that is perpendicular to said sides and wherein said sides form a pair of corners with said top for each of said tabs.

9. An imaging member assembly according to claim 8 wherein said pair of corners are embedded in said inner surface of said hollow cylindrical electrostatographic imaging member.

10. An imaging member assembly according to claim 9 wherein said pair of corners are embedded in said inner surface of said hollow cylindrical electrostatographic imaging member to at least a depth of 10 micrometers.

11. An imaging member assembly according to claim 8 wherein said pair of corners are sufficiently embedded in said inner surface of said hollow cylindrical electrostatographic imaging member to resist slippage between said end flange and said inner surface under an applied torque of at least about 0.5 Newton-meters.

12. An imaging member assembly according to claim 8 wherein said top has a flat surface and substantially all of said surface is in contact with said hollow cylindrical electrostatographic imaging member.

13. An imaging member assembly according to claim 8 wherein said top of each of said tabs has a center point and an imaginary circle joining said center point of said tops has a diameter that is substantially equal to the inside diameter of said imaging member.

14. An imaging member assembly according to claim 8 wherein said tabs have a tensile yield stress point at least about 10 percent greater than the tensile yield stress point of said inner surface of said hollow cylindrical electrostatographic imaging member.

15. A method for securing a reusable end flange to a hollow cylindrical electrostatographic imaging member having an inner surface comprising providing at least one end flange, said end flange comprising a disk shaped member, a supporting hub extending axially from said disk shaped member, and a flat rigid metal disk coaxially secured to said hub, said metal disk comprising a plurality of rectangular tabs extending radially from said disk in a direction away from and perpendicular to an imaginary axis of said hub into engagement with said inner surface of said hollow cylindrical electrostatographic imaging member, and inserting a portion of said end flange into one end of said imaging member, said insertion causing said tabs to shave "V" shaped strips of material from said inner surface and said tabs after insertion having a shape substantially the same shape as immediately prior to said insertion.

16. A method according to claim 15 including inserting a supporting shaft extending axially through said end flange and applying a torque to said end flange.

17. A method according to claim 16 including providing electrical grounding of said inner surface of said imaging member to said shaft through said metal disk.

18. A method according to claim 16 including removing said end flange from said end of said imaging member and inserting a portion of said end flange into one end of another hollow cylindrical electrostatographic imaging member.

* * * * *